US009858839B2

(12) United States Patent
Wang et al.

(10) Patent No.: US 9,858,839 B2
(45) Date of Patent: Jan. 2, 2018

(54) NAKED EYE THREE-DIMENSIONAL DISPLAY PANEL AND OVERDRIVING METHOD THEREOF

(71) Applicant: Shenzhen China Star Optoelectronics Technology Co., Ltd., Shenzhen, Guangdong (CN)

(72) Inventors: Limin Wang, Guangdong (CN); Tai-jiun Hwang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 77 days.

(21) Appl. No.: 14/761,400

(22) PCT Filed: May 20, 2015

(86) PCT No.: PCT/CN2015/079367
§ 371 (c)(1),
(2) Date: Jul. 16, 2015

(87) PCT Pub. No.: WO2016/176875
PCT Pub. Date: Nov. 10, 2016

(65) Prior Publication Data

US 2016/0329007 A1 Nov. 10, 2016

(30) Foreign Application Priority Data

May 7, 2015 (CN) ..... 2015 1 0229805

(51) Int. Cl.
*G09G 5/00* (2006.01)
*G09G 3/00* (2006.01)
*G09G 3/36* (2006.01)

(52) U.S. Cl.
CPC ..... *G09G 3/003* (2013.01); *G09G 3/3648* (2013.01); *G09G 2320/0252* (2013.01); *G09G 2320/0285* (2013.01)

(58) Field of Classification Search
CPC .... G09G 3/003; G09G 3/3614; G09G 3/3696; G09G 2300/0426; G02F 1/133606; G02F 1/134309; G02F 2201/121; G02F 2001/133607
See application file for complete search history.

(56) References Cited

U.S. PATENT DOCUMENTS

2009/0009508 A1* 1/2009 Koo ..... H04N 13/0454 345/214
2013/0148067 A1* 6/2013 Wang ..... G02F 1/1343 349/138

* cited by examiner

*Primary Examiner* — Adam R Giesy
(74) *Attorney, Agent, or Firm* — Andrew C. Cheng

(57) ABSTRACT

The disclosure is related to a naked eye three-dimensional display panel and an overdriving method. The overdriving method comprises: obtaining target voltages and overdriving voltages of driving electrodes; searching overdriving periods corresponding to the target voltages and the driving voltages in a preset look-up table, wherein mapping relations for different values of the target voltages, the overdriving voltages and the overdriving periods are stored in the preset look-up table; generating overdriving signals according to the obtained target voltages, the obtained driving voltages and the searched overdriving periods; and driving the liquid crystal prism. The disclosure can avoid the issues of insufficient overdriving and excessive overdriving and the naked eye three-dimensional displaying effect using the overdriving technology can be assured.

13 Claims, 2 Drawing Sheets

| | | | |
|---|---|---|---|
| $T_{00}$ | $T_{01}$ | … | $T_{0n}$ |
| … | … | … | … |
| $T_{m0}$ | $T_{m1}$ | … | $T_{mn}$ |

NAKED EYE THREE-DIMENSIONAL DISPLAY PANEL AND OVERDRIVING METHOD THEREOF

BACKGROUND

Technical Field

The disclosure is related to the liquid crystal display technology, and specifically related to the technical field of the three-dimensional display, and more particularly to a naked eye three-dimensional display panel and an overdriving method.

Related Art

The naked eye three-dimensional display technology is achieved by controlling the liquid crystal deflection through applying the driving voltage to the driving electrodes of the liquid crystal prism. Currently, the raising and descending time of the driving voltage during the reversal process can be decreased by adopting the overdriving technology to drive the liquid crystal prism and improve the stability of the naked eye three-dimensional display effect. The core of the overdriving technology is the selection of the overdriving period. That is to say when the overdriving finishes, the alternating voltage precisely raises to the target voltage. When the overdriving period finishes, the situation that the alternating voltage does not achieve the target voltage is referred as insufficient overdriving while the situation that the alternating voltage exceeds the target voltage is referred as excess overdriving. The present overdriving technology generates a driving signal according to the fixed overdriving period. However, the fixed overdriving period would cause that the overdriving is insufficient or the overdriving is excessive because the driving voltages applied on each driving electrode are different and the different value between the voltages is larger. It influences the naked eye three-dimensional displaying effect using the overdriving technology.

SUMMARY

The embodiment of the disclosure provides a naked eye three-dimensional display panel and an overdriving method in order to improve the naked eye three-dimensional displaying effect using the overdriving technology.

The embodiment of the disclosure provides an overdriving method of a naked eye three-dimensional display panel. A liquid crystal prism of the naked eye three-dimensional display panel comprises a plurality of driving electrodes arranged apart and a common electrode opposite to the plurality of driving electrodes, the plurality of driving electrodes and the common electrode connecting to the same driving power source. The overdriving method comprises: obtaining target voltages and overdriving voltages applied to the plurality of driving electrodes, wherein the target voltages applied to the adjacent driving electrodes are different, and the driving voltages applied to the adjacent driving electrodes are different; searching overdriving periods corresponding to the target voltages and the driving voltages in a preset look-up table, wherein mapping relations for different values of the target voltages, the overdriving voltages and the overdriving periods are stored in the preset look-up table; generating overdriving signals according to the obtained target voltages, the obtained driving voltages and the searched overdriving periods; and driving the liquid crystal prism.

In one embodiments of the disclosure, the liquid crystal prism of the naked eye three-dimensional display panel comprises a common electrode opposite to the plurality of driving electrodes, and the steps of generating the overdriving signals and driving the liquid crystal prism comprises: applying driving signals with same frequency and opposite polarity to the driving electrodes and the common electrode wherein the driving signals are alternating voltage driving signals; or wherein the driving signals applying to the driving electrodes are alternating voltage driving signals and the driving signals applying to the common electrode are direct voltage driving signals.

In one embodiments of the disclosure, the common electrode is a plane structure and the driving electrodes are strip structures.

The embodiment of the disclosure further provides an overdriving method of a naked eye three-dimensional display panel. A liquid crystal prism of the naked eye three-dimensional display panel comprises a plurality of driving electrodes arranged in spaced, the overdriving method comprising: obtaining target voltages and overdriving voltages applied to the plurality of driving electrodes; searching an overdriving period corresponding to the target voltages and the driving voltages in a preset look-up table, wherein mapping relations for different values of the target voltages, the overdriving voltages and the overdriving period are stored in the preset look-up table; generating overdriving signals according to the obtained target voltages, the obtained driving voltages and the searched overdriving periods; and driving the liquid crystal prism.

In one embodiments of the disclosure, the target voltages applied to the adjacent driving electrodes are different, and the driving electrodes applied to the adjacent driving voltages are different.

In one embodiments of the disclosure, the liquid crystal prism comprises a common electrode opposite to the plurality of driving electrodes, and the steps of generating the overdriving signals and driving the liquid crystal prism comprises: applying driving signals with same frequency and opposite polarity to the driving electrodes and the common electrode, wherein the driving signals are alternating voltage driving signals; or wherein the driving signals applying to the driving electrodes are alternating voltage driving signals and the driving signals applying to the common electrode are direct voltage driving signals.

In one embodiments of the disclosure, the plurality of driving electrodes and the common electrode connect to the same driving power source.

In one embodiments of the disclosure, the common electrode is a plane structure and the driving electrodes are strip structures.

The embodiment of the disclosure further provides a naked eye three-dimensional display panel. The naked eye three-dimensional display panel comprises a display panel and a liquid crystal prism at the light output direction of the display panel and disposed adjacent to the display panel; wherein the liquid crystal prism comprises a driving controller and a plurality of driving electrodes arranged in an internal; wherein the driving controller obtains target voltages and overdriving voltages applied to the plurality of driving electrodes; the driving controller searches an overdriving period corresponding to the target voltages and the driving voltages in a preset look-up table, wherein mapping relations in different values of the target voltages, the overdriving voltages and the overdriving period are stored in the preset look-up table; the driving controller generates overdriving signals according to the target voltages, the driving voltages and the overdriving periods obtained by searching; and the driving controller drives the liquid crystal prism.

In one embodiments of the disclosure, the target voltages received by the adjacent driving electrodes are different, and the driving voltages received by the adjacent driving electrodes are different.

In one embodiments of the disclosure, the liquid crystal prism further comprise a common electrode opposite to the driving electrodes; driving signals received by the driving electrodes and the common electrode having the same frequency and opposite polarity are alternating voltage driving signals; or wherein the driving signals received by the driving electrodes are the alternating voltage driving signals and the driving signals received by the common electrode are the direct voltage driving signals.

In one embodiments of the disclosure, the plurality of driving electrodes and the common electrode connect to the same driving power source.

In one embodiments of the disclosure, the common electrode is a plane structure and the driving electrodes are strip structures.

The embodiments of the disclosure of the naked eye three-dimensional display panel and the overdriving method obtains the overdriving period according to the target voltage and the overdriving voltage applied on each driving electrode. All of the driving electrodes do not use only one fixed overdriving period to overdrive. Therefore, the issues of the insufficient overdriving or the excessive overdriving caused by the fixed overdriving period can be avoided and the naked eye three-dimensional displaying effect using the overdriving technology can be assured.

BRIEF DESCRIPTION OF THE DRAWINGS

In order to more clearly illustrate the prior art or the embodiments or aspects of the practice of the disclosure, the accompanying drawings for illustrating the prior art or the embodiments of the disclosure are briefly described as below. It is apparently that the drawings described below are merely some embodiments of the disclosure, and those skilled in the art may derive other drawings according the drawings described below without creative endeavor.

DETAILED DESCRIPTION

The following description with reference to the accompanying drawings is provided to clearly and completely explain the exemplary embodiments of the disclosure. It is apparent that the following embodiments are merely some embodiments of the disclosure rather than all embodiments of the disclosure. According to the embodiments in the disclosure, all the other embodiments attainable by those skilled in the art without creative endeavor belong to the protection scope of the disclosure.

Figure 1:
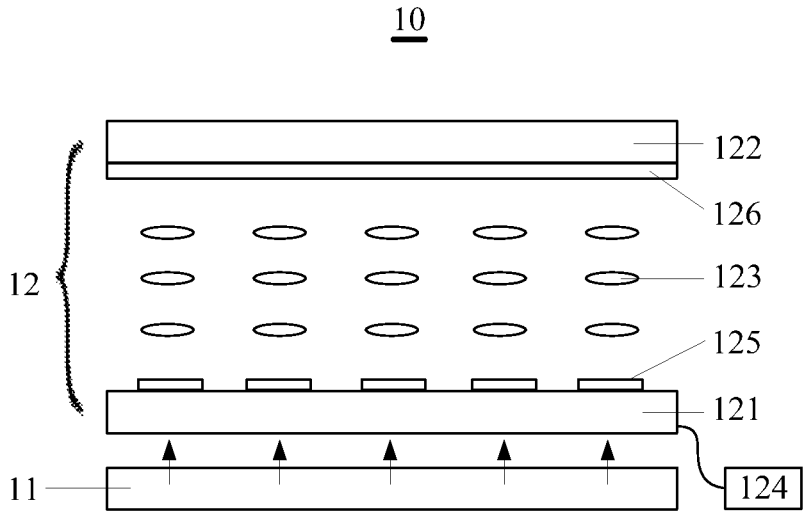
FIG. 1 is the sectional view of the structure of the naked eye three-dimensional display panel according to the embodiment of the disclosure.

FIG. 1 is the sectional view of the structure of the naked eye three-dimensional display panel according to the embodiment of the disclosure. As shown in FIG. 1, a naked eye three-dimensional display panel 10 comprises a display panel 11 and a liquid crystal prism 12 at the light output direction (as shown by the arrow) of the display panel 11 and disposed adjacent to the display panel 11. The display panel 11 is the traditional two-dimensional liquid crystal display panel.

The liquid crystal prism 12 comprises a first substrate 121, a second substrate 122, liquid crystals 123 and a driving controller 124. The first substrate 121 and the second substrate 122 are arranged apart. One side adjacent to the liquid crystals 123 of the first substrate 121 is disposed with a plurality of driving electrodes 125 arranged apart. One side adjacent to the liquid crystals 123 of the second substrate 122 is disposed with a common electrode 126. The driving electrodes 125 and the common electrode 126 receive driving signals under the controlling of the driving controller 124. The liquid crystals 124 sandwiched between the first substrate 121 and the second substrate 122 deflect and form a columnar prism such that human eyes can watch the display panel 11 at the light output direction and enjoy the three-dimensional display effect.

Figure 2:
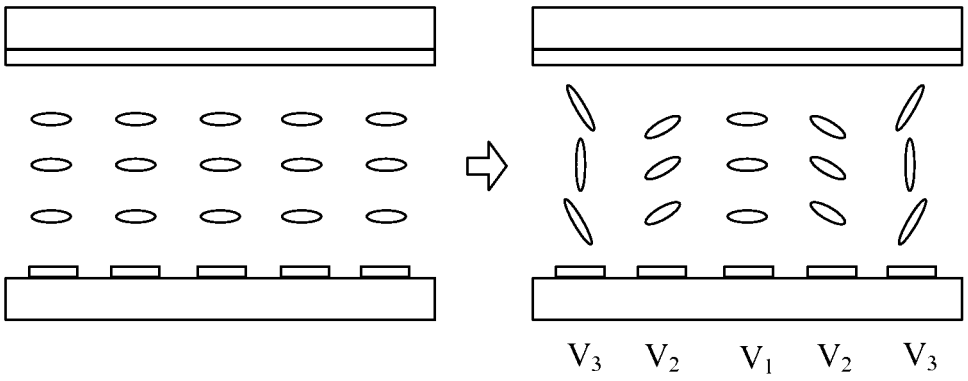
FIG. 2 is the schematic diagram of the liquid crystal prism applied with a target voltage as shown in FIG. 1.

The target voltages applied to the adjacent driving electrodes 125 are different. The driving voltages applied to the adjacent driving electrodes 125 are different. As shown in FIG. 2, the target voltages received by the driving electrodes 125 gradually increases along the direction from the central area to the two edge area in the formed columnar prism. That is $V_3>V_2>V_1$. The driving electrodes 125 of the embodiment are strip structures and the common electrode is a plane structure.

The driving signals of the embodiment are overdriving signals, which are essentially a voltage driving signal. The acquisition method is that: first, the driving controller 124 obtains target voltages and overdriving voltages applied to the plurality of driving electrodes 125. A look-up-table are previously stored in the storage unit of the driving controller 124 or the storage unit of the central process unit of the naked eye three-dimensional display panel 10. Mapping relations for different values of the target voltages, the overdriving voltages and the overdriving periods are stored in the preset look-up table. The driving controller 124 obtains the overdriving period corresponding to the target voltage and the overdriving voltage through searching. Finally, the driving controller 124 generates overdriving signals according to the obtained target voltages, the obtained driving voltages and the searched overdriving periods.

The embodiment of the disclosure uses the overdriving technology to achieve the three-dimensional display and reduces the time of deflecting to the preset angel. The driving controller 124 does not use a fixed overdriving period to drive all the driving electrodes 125. The driving controller 124 applies the corresponding overdriving period according to the target voltages needed to receive and the overdriving voltages. Compared with the present technology that uses the fixed overdriving period to all the driving electrodes 125, the embodiment of the disclosure can avoid the insufficient overdriving and excessive overdriving and the naked eye three-dimensional displaying effect using the overdriving technology can be assured.

Figures 3, 4:
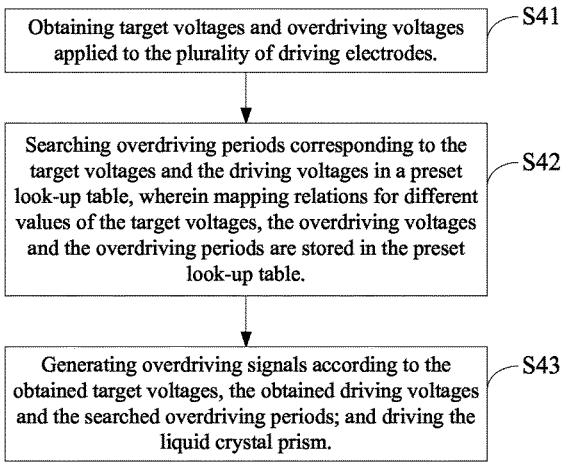
FIG. 3 is the schematic diagram of the displaying look-up table according to the embodiment of the disclosure.
FIG. 4 is the flow chart of the overdriving method of the naked eye three-dimensional display panel according to one embodiment of the disclosure.

The look-up table essentially is a random access memory (RAM). The overdriving periods with the different values are previously written in the RAM. Whenever a target voltage and an overdrive voltage is entered corresponds inputting an address to look up the table to obtain the corresponding values of the overdriving periods. As shown in FIG. 3, addresses are constituted by m columns and n rows corresponding to the different values of the overdriving periods. Each column corresponds to a value of the overdriving periods and each row corresponds to a value of the target voltage. In the embodiment of the disclosure, m and n are positive integers. Assigning different values to both m and n can provide more values for selecting the overdriving periods. The target voltages and the overdriving voltages can be applied to more cases, and thereby increase the accuracy of the overdriving periods, and further improve the naked eye three-dimensional display effect.

In the embodiment of the disclosure, the driving signals received by each driving electrodes 125 are the alternating voltage driving signals. The driving signals received by the common electrode 126 are the direct voltage driving signals. The direct voltage driving signals regard as the reference voltage driving signals. A voltage difference and an electric field are produced between each driving electrode 125 and common electrode 126. Thus the deflection of the liquid crystals 123 is controlled.

In another embodiment of the disclosure, the driving electrodes 125 and the common electrode 126 may receive the alternating voltage driving signals with the same frequency and opposite polarity. If the alternating voltage driving signal received by the common electrode 126 has a first amplitude $F_1$ and the alternating voltage driving signal received by the driving electrodes 125 has a second amplitude $F_2$, the relative voltage difference of the alternating voltage driving signal received by the driving electrodes 125 and the common electrode 126 is the sum of the first amplitude $F_1$ and the second amplitude $F_2$, that is $F_1+F_2$. Therefore, when the required deflection angel of the liquid crystal 133 is achieved by applying the direct voltage driving signal to the common electrode 126, that is the third voltage amplitude $F_3$ arrived at a time t, the sum of the first amplitude $F_1$ and the second amplitude $F_2$ corresponding to the time t is equal to the third voltage amplitude $F_3$, that is $F_1+F_2=F_3$. when the first amplitude $F_1$ corresponding to the time t is equal to the second amplitude $F_2$ corresponding to the time t, that is $F_1=F_2$, the alternating voltage driving signals having the same driving effect can be generated by applying a half of the present alternating voltage. That is $2*F_1=F_3$ and $2*F_2=F_3$ now. The voltage output range of the driving circuit of the naked eye three-dimensional display panel 10 is $-\frac{1}{2}F_3 \sim +\frac{1}{2}F_3$ or $-F_1 \sim +F_1$ or $-F_2 \sim +F_2$. It is only a half of the voltage output range of the driving circuit applying the direct voltage driving signal to the common electrode 126. Thus the requirement of the output voltage of the driving circuit decreases to assure the stability and loading ability of the driving circuit, especially the driving power source. In the embodiment of the disclosure, the plurality of driving electrodes 125 and the common electrode 126 connect to the same driving power source in order to generate the alternating voltage of the foregoing alternating voltage driving signal.

FIG. 4 is a flow chart of the overdriving method of the naked eye three-dimensional display panel according to one embodiment of the disclosure. As shown in FIG. 4, the embodiment of the overdriving method comprises:

Step S41: obtaining target voltages and overdriving voltages applied to the plurality of driving electrodes.

Step S42: searching overdriving periods corresponding to the target voltages and the driving voltages in a preset look-up table, wherein mapping relations for different values of the target voltages, the overdriving voltages and the overdriving periods are stored in the preset look-up table.

Step S43: generating overdriving signals according to the obtained target voltages, the obtained driving voltages and the searched overdriving periods; and driving the liquid crystal prism.

The overdriving method of the embodiment can be performed correspondingly by each structure element of the foregoing naked eye three-dimensional display panel 10. The specific process of the overdriving method can be found in the foregoing overdriving process of the naked eye three-dimensional display panel 10 and is not be mentioned here.

In summary, the core purpose of the embodiment of the disclosure is obtaining the overdriving period according to the target voltage and overdriving voltage applied to each driving electrode 125. All the overdriving electrodes 125 are not driven by a fixed overdriving period and the issues of insufficient overdriving and excessive overdriving caused by using the fixed overdriving period are avoided. The naked eye three-dimensional displaying effect using the overdriving technology is assured.

Note that the specifications relating to the above embodiments should be construed as exemplary rather than as limitative of the present disclosure. The equivalent variations and modifications on the structures or the process by reference to the specification and the drawings of the disclosure, or application to the other relevant technology fields directly or indirectly should be construed similarly as falling within the protection scope of the disclosure.

What is claimed is:

1. An overdriving method of a naked eye three-dimensional display panel, wherein a liquid crystal prism of the naked eye three-dimensional display panel comprises a plurality of driving electrodes arranged apart and a common electrode opposite to the plurality of driving electrodes, the plurality of driving electrodes and the common electrode connecting to the same driving power source, the overdriving method comprising:

obtaining target voltages and overdriving voltages applied to the plurality of driving electrodes, wherein the target voltages applied to the adjacent driving electrodes are different, and the overdriving voltages applied to the adjacent driving electrodes are different;

searching overdriving periods corresponding to the target voltages and the overdriving voltages in a preset look-up table, wherein mapping relations for different values of the target voltages, different values of the overdriving voltages and different values of the overdriving periods are stored in the preset look-up table so that each one of the target voltages together with each one of the overdriving voltages define a corresponding one of the overdriving periods, and at least two overdriving periods having values different from each other are defined by the target voltages and the overdriving voltages;

generating overdriving signals according to the obtained target voltages, the obtained overdriving voltages and the searched overdriving periods; and driving the liquid crystal prism.

2. The overdriving method according to claim 1, wherein the liquid crystal prism of the naked eye three-dimensional display panel comprises the common electrode opposite to the plurality of driving electrodes, and the steps of generating the overdriving signals and driving the liquid crystal prism comprises:

applying driving signals with same frequency and opposite polarity to the driving electrodes and the common electrode wherein the driving signals are alternating voltage driving signals;

or wherein the driving signals applying to the driving electrodes are alternating voltage driving signals and the driving signals applying to the common electrode are direct voltage driving signals.

3. The overdriving method according to claim 2, wherein the common electrode is a plane structure and the driving electrodes are strip structures.

4. An overdriving method of a naked eye three-dimensional display panel, wherein a liquid crystal prism of the naked eye three-dimensional display panel comprises a plurality of driving electrodes arranged in spaced, the overdriving method comprising:

obtaining target voltages and overdriving voltages applied to the plurality of driving electrodes;

searching overdriving periods corresponding to the target voltages and the overdriving voltages in a preset look-up table, wherein mapping relations for different values of the target voltages, different values of the overdriving voltages and different values of the overdriving periods are stored in the preset look-up table so that each one of the target voltages together with each one of the overdriving voltages define a corresponding one of the overdriving periods, and at least two overdriving periods having values different from each other are defined by the target voltages and the overdriving voltages;

generating overdriving signals according to the obtained target voltages, the obtained overdriving voltages and the searched overdriving periods; and driving the liquid crystal prism.

5. The overdriving method according to claim 4, wherein the target voltages applied to the adjacent driving electrodes are different, and the overdriving voltages applied to the adjacent driving electrodes are different.

6. The overdriving method according to claim 4, wherein the liquid crystal prism comprises a common electrode opposite to the plurality of driving electrodes, and the steps of generating the overdriving signals and driving the liquid crystal prism comprises:

applying driving signals with same frequency and opposite polarity to the driving electrodes and the common electrode, wherein the driving signals are alternating voltage driving signals;

or wherein the driving signals applying to the driving electrodes are alternating voltage driving signals and the driving signals applying to the common electrode are direct voltage driving signals.

7. The overdriving method according to claim 6, wherein the plurality of driving electrodes and the common electrode connect to the same driving power source.

8. The overdriving method according to claim 6, wherein the common electrode is a plane structure and the driving electrodes are strip structures.

9. A naked eye three-dimensional display panel, comprising:

a display panel; and a liquid crystal prism at a light output direction of the display panel and disposed adjacent to the display panel;

wherein the liquid crystal prism comprises a driving controller and a plurality of driving electrodes arranged in an internal;

wherein the driving controller obtains target voltages and overdriving voltages applied to the plurality of driving electrodes; the driving controller searches overdriving periods corresponding to the target voltages and the overdriving voltages in a preset look-up table, wherein mapping relations for different values of the target voltages, different values of the overdriving voltages and different values of the overdriving periods are stored in the preset look-up table so that each one of the target voltages together with each one of the overdriving voltages define a corresponding one of the overdriving periods, and at least two overdriving periods having values different from each other are defined by the target voltages and the overdriving voltages; the driving controller generates overdriving signals according to the target voltages, the overdriving voltages and the overdriving periods obtained by searching; and the driving controller drives the liquid crystal prism.

10. The naked eye three-dimensional display panel according to claim 9, wherein the target voltages received by the adjacent driving electrodes are different, the overdriving voltages received by the adjacent driving electrodes are different.

11. The naked eye three-dimensional display panel according to claim 9, wherein the liquid crystal prism further comprise a common electrode opposite to the driving electrodes; driving signals received by the driving electrodes and the common electrode having the same frequency and opposite polarity are alternating voltage driving signals; or wherein the driving signals received by the driving electrodes are the alternating voltage driving signals and the driving signals received by the common electrode are the direct voltage driving signals.

12. The naked eye three-dimensional display panel according to claim 11, wherein the plurality of driving electrodes and the common electrode connect to the same driving power source.

13. The naked eye three-dimensional display panel according to claim 11, wherein the common electrode is a plane structure and the driving electrodes are strip structures.

* * * * *